US006588134B1

(12) United States Patent
Perelli

(10) Patent No.: US 6,588,134 B1
(45) Date of Patent: Jul. 8, 2003

(54) HANGING SIGN AND METHOD

(75) Inventor: Thomas Perelli, Winchester, VA (US)

(73) Assignee: Rubbermaid Commercial Products LLC, Winchester, VA (US)

( * ) Notice: Subject to any disclaimer, the term of this patent is extended or adjusted under 35 U.S.C. 154(b) by 0 days.

(21) Appl. No.: 09/549,532

(22) Filed: Apr. 14, 2000

(51) Int. Cl.[7] ..... G09F 7/22
(52) U.S. Cl. ..... 40/617; 40/331
(58) Field of Search ..... 40/617, 599, 331, 40/673, 661.12, 607, 658, 660, 661.08, 1; D20/42; D10/109; 248/339; 116/63 P, 63 T

(56) References Cited

U.S. PATENT DOCUMENTS

| | | | | | |
|---|---|---|---|---|---|
| 879,426 | A | | 2/1908 | Townsend | |
| 978,218 | A | * | 12/1910 | Sargent | 239/54 |
| 1,249,411 | A | * | 12/1917 | Joseph | 40/1 |
| 1,535,844 | A | * | 4/1925 | McLemore | 40/563 |
| 1,635,915 | A | * | 7/1927 | White | 116/30 |
| 2,580,671 | A | * | 1/1952 | Goyette | 40/617 |
| 2,871,598 | A | * | 2/1959 | Pawelka | 40/561 |
| 2,928,197 | A | * | 3/1960 | Zuckerman | 40/561 |
| 3,736,682 | A | | 6/1973 | Farmer et al. | |
| D242,502 | S | * | 11/1976 | Hublitsky | D20/29 |
| 4,240,543 | A | * | 12/1980 | McKee | 206/39 |
| 4,290,218 | A | | 9/1981 | Drueck, Jr. | |
| 4,392,316 | A | * | 7/1983 | Thomas | 40/617 |
| 4,426,801 | A | * | 1/1984 | Gates | 40/606 |
| 4,462,175 | A | * | 7/1984 | Romberger | 40/1 |
| D277,738 | S | | 2/1985 | Grammas et al. | |
| 4,667,428 | A | * | 5/1987 | Elmer | 40/592 |
| 4,884,350 | A | * | 12/1989 | Whetstone | 40/124 |

(List continued on next page.)

OTHER PUBLICATIONS

Rubbermaid Floor Signs, Rubbermaid Catalog (undated).
Safety Cones and Accessories Catalog, Lamba Systems 1990.
Safety Cones, Continental Manufacturing Co. Catalog (undated).
Plastic Safety Signs, Secure Floor System, White Catalog, pp. 57–58 (undated).
Two–Sided Floor Stand Signs, Lab Safety Supply Catalog, p. 1882 (undated).
Reversible Floor Signs, Lab Safety Supply Catalog, p. 1883 (undated).
Floor Signs—Industrial Floor Signs and Warning Cones and Floor Signs, Conney Catalog, p. 271 (undated).
"The Boys", BARCO Products Company Catalog (undated).
Four On The Floor, Lamba Systems, Maintenance Supplies, Dec. 1998, p. 15.
Minders Sign & Barrier System (undated).
Safety Warning Signs, BARCO Products Company (undated).
Traffic Safety Posts, BARCO Products Company (undated).
Caution Signs, The Camel Lot, 1987.
Lamba Cones and Accessories, Lamba Systems (undated).
Corrugated Plastic, Woodruff Corporation (undated).
Lamba Safety Cones and Accessories, Lamba Systems (undated).

*Primary Examiner*—William Miller
(74) *Attorney, Agent, or Firm*—Foley & Lardner

(57) ABSTRACT

A hanging sign is provided for displaying messages. The sign may include a pair of walls that face in generally opposite directions so that messages can be displayed in two general directions, and a hook for hanging the walls from a support, such as a handrail assembly or other stanchion. The sign also may be configured to hang from a door handle and include a single display panel angled to face a pedestrian approaching the door. The sign may have a cavity to provide for nesting of a plurality of similar signs. A method is disclosed for hanging a sign to provide information to pedestrians.

22 Claims, 6 Drawing Sheets

U.S. PATENT DOCUMENTS

| | | | | | |
|---|---|---|---|---|---|
| D310,245 | S | | 8/1990 | von Canal | |
| D317,580 | S | | 6/1991 | Thurston | |
| 5,199,375 | A | | 4/1993 | Johson | |
| 5,249,771 | A | * | 10/1993 | Wear | 248/317 |
| D341,030 | S | * | 11/1993 | Jamieson | D6/300 |
| 5,355,604 | A | * | 10/1994 | Rathke | 40/601 |
| 5,409,161 | A | * | 4/1995 | Haskett | 232/1 C |
| D360,127 | S | | 7/1995 | Stiner | |
| D386,214 | S | * | 11/1997 | Belokin et al. | D20/42 |
| 5,724,909 | A | * | 3/1998 | Pitman et al. | 116/202 |
| D403,360 | S | | 12/1998 | Cobb et al. | |
| D413,356 | S | | 8/1999 | Ingram | |
| D415,526 | S | | 10/1999 | Ho | |
| D418,171 | S | * | 12/1999 | Robinson et al. | D20/42 |
| D429,286 | S | | 8/2000 | Luciani et al. | |
| 6,178,673 | B1 | * | 1/2001 | Blackford et al. | 40/440 |
| D439,280 | S | * | 3/2001 | Perelli | D20/42 |
| 6,212,809 | B1 | * | 4/2001 | Gaule | 40/660 |
| D450,350 | S | * | 11/2001 | Perelli | D20/42 |

* cited by examiner

FIG.10
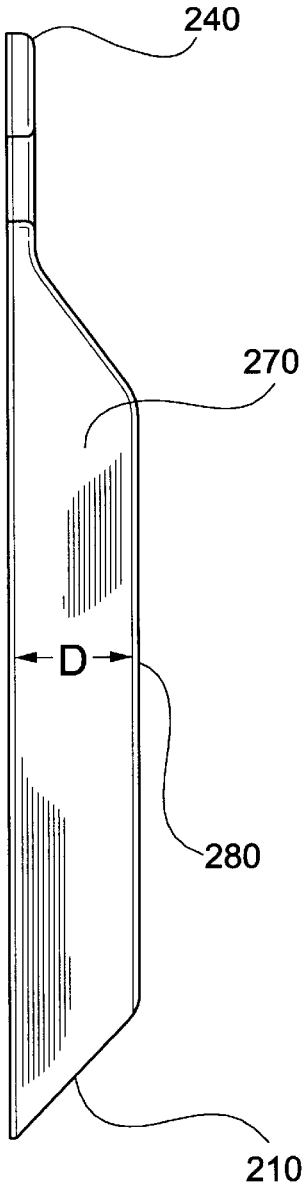
FIG.9
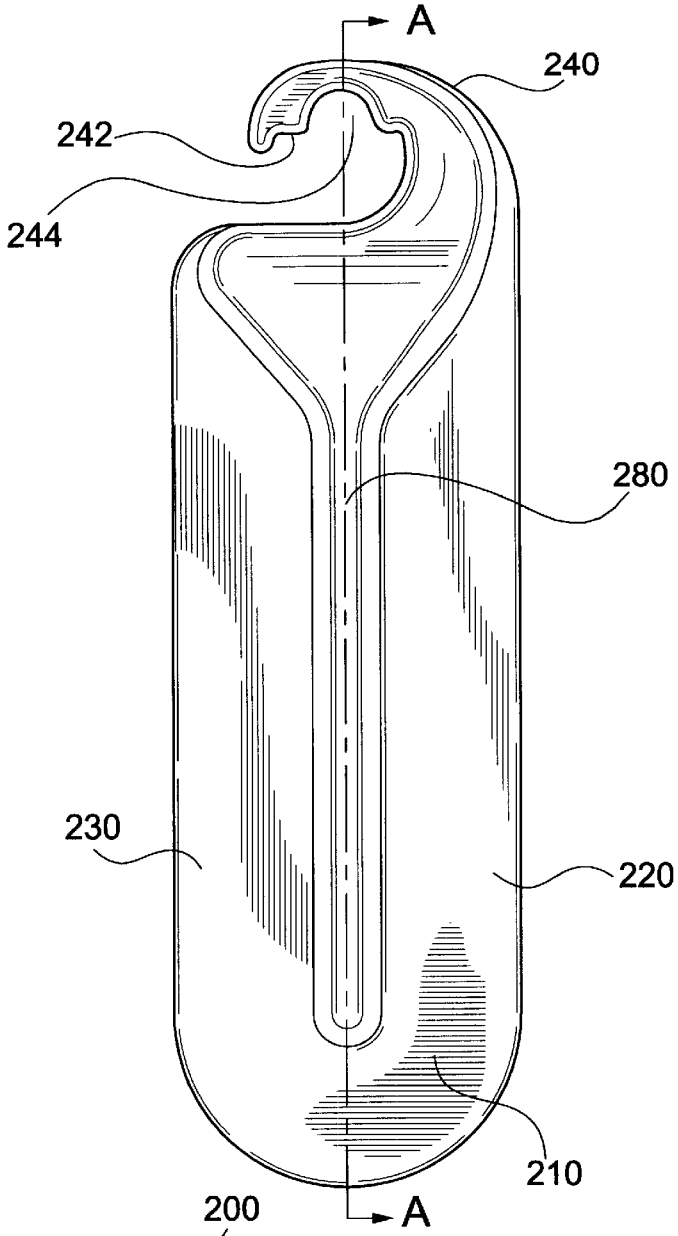
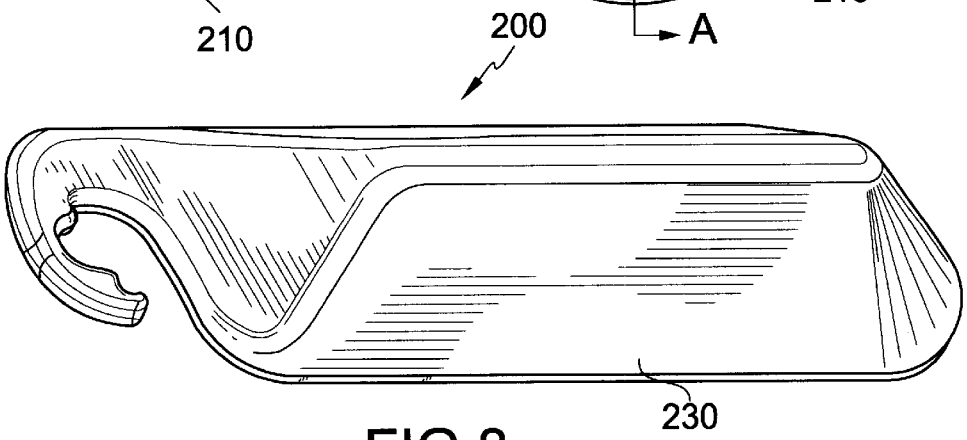
FIG.8

HANGING SIGN AND METHOD

FIELD OF THE INVENTION

The present invention relates generally to signs and particularly to signs that convey a message to a pedestrian.

BACKGROUND OF THE INVENTION

Traditionally, floor signs have been used to convey messages regarding hazardous conditions. For example, floor signs have been used to inform pedestrians of hazardous or unusual surface conditions, such as wet, waxed, or newly painted floors. Floor signs typically take the shape of cones, pyramids or folding signs.

Conventional floor signs have significant disadvantages. A floor sign can pose a significant trip hazard. Also, a floor sign sometimes cannot be placed near the hazardous area. For example, floor signs may not be placed directly on stairways or steps due to the trip hazard associated therewith and due to the restrictions imposed by governing regulations in most jurisdictions that specify the required amount of unobstructed surface on each step. To warn pedestrians of a wet or slippery step, for example, floor signs must be placed directly above and/or below the affected flight of stairs. Pedestrians may not exercise appropriate care, because the floor sign cannot be placed directly in the area of concern. Furthermore, once a pedestrian has passed by the floor sign the existence of the hazardous condition may be forgotten.

Thus, there remains a need for a sign that can be positioned directly in an area containing a condition requiring a pedestrian's attention. These areas may include, for example, a wet stair, a wet floor, a hazardous condition beyond a closed door, an out of service elevator or an area in need of a directional marker, etc.

A further disadvantage associated with conventional floor signs is that the sign is typically positioned well below the field of vision of a pedestrian. As a result, the sign may be overlooked. The magnitude of the problem increases as the pedestrian moves closer to the sign. Thus, there remains a need for a sign that may be placed further from the surface being walked upon so that the pedestrian is more likely to be aware of the sign and consider the message being displayed.

Signs have previously been hung from door handles to provide information to pedestrians. In order to avoid interference with the operation of the door handle, however, these signs typically are essentially two-dimensional. As a result, a conventional door handle sign tends to blend in with the surface of the door and a pedestrian is not alerted to the presence of the sign until he is directly in front of the door. At that point the sign may be difficult to read, as it is typically flush against the door and below the door handle. Thus, there remains a need for a sign capable of being hung from a door handle that does not interfere with operation of the door handle, is easy to read, and is configured to alert pedestrians to the presence of the sign before their arrival in front of the door.

Due to the high demand for warning signs there is a need for a lightweight sign that may be packed and stored efficiently. Existing floor signs provide for folding or compacting features so that the signs may be bulk shipped or stored and several different conventional floor signs are fabricated from lightweight plastic material. However, due to the relatively large size requirements, existing floor signs may still be heavy and difficult to handle. As a result, there remains a need for a lightweight hanging sign that may be compactly stored and shipped to minimize space and shipping costs.

The present invention meet the needs set forth above, and provides other benefits as well.

SUMMARY OF THE INVENTION

According to the present invention, there is provided a hanging sign that includes a first wall having a first surface for displaying a message and a second wall having a second surface for displaying a message. The first and second surfaces may be positioned to face in generally opposing directions. The sign further includes a hook member c connected to the walls and configured to be placed about a support. The walls may be angled to improve the viewing angle for a passerby viewing the sign. The walls may be connected together at respective side edges to form a v-shaped cross-section or may be separated by a flat transition panel. The sign may include a cavity back, a hollow interior or a solid interior.

The present invention also includes a sign that may be hung from a hand railing assembly for a staircase. The sign may include a first wall for displaying information in the direction of the top of the staircase, and a second wall for displaying information in the direction of the bottom of the staircase. A hook member is configured to support the walls and to be placed about a portion of the hand railing assembly. The staircase sign may include a base wall connected to bottom edges of the first and second walls. The sign may include a cavity to permit nesting of another staircase sign within the cavity. The walls may be connected to form a v-shaped cross-section. The hook may include a further recess sized to fit around the railing assembly. The sign may also include a hollow or solid interior.

The present invention may further include a method of providing information to people moving along a railing assembly. The method includes providing a sign that has a first surface for displaying information to people moving along the railing in one direction and a second surface for displaying information to people moving along the railing in a second direction substantially opposite to the first direction, and a hook member for hanging the walls from the railing assembly by placing the hook member on the railing assembly. According to the present invention, the method may include placing the sign above a bottom step of a flight of stairs and below a top step of a flight stairs so that information on the sign is visible to people moving both up and down the flight of stairs.

According to the present invention there may also be provided a sign that includes a display panel for displaying information, and a pair of side walls, each of the side walls being connected to a side edge of the display panel and increasing in width from a top of the display panel to a bottom of the display panel. The sign may include a hook member connected to the walls and configured to be placed about a support. The side walls and the display panel may be configured to form a cavity to permit nesting of another sign within the cavity. The side walls may be substantially parallel and extend at a substantially right angle relative to the display panel.

The present invention includes a sign for hanging on a door handle so that a person approaching the door from a direction parallel to the plane of the door is alerted to the presence of the sign. The door handle sign includes a display panel for displaying information, and a pair of side walls. Each of the side walls is connected to a side edge of the display panel and has an increasing width from the top of the display panel to the bottom of the display panel. The sign also includes a hook connected to the walls and configured to be placed about the door handle. The side walls may be of sufficient width adjacent the bottom of the display panel and may be positioned to project away from the door so that at least one of the side walls is visible when approaching the door. The door handle sign may also include a cavity to permit nesting of similar signs.

The present invention also includes a method of alerting a person approaching a door to the presence of a sign on the door handle. The method includes providing a sign having a display panel for displaying information, and a pair of side walls, each of the side walls being connected to a side edge of the display panel and increasing in width from a top of the display panel to a bottom of the display panel. The method includes placing the sign about the door handle so that one of the side walls projects away from the door and is visible when approaching the door.

It is to be understood that both the foregoing general description and the following detailed description are exemplary and explanatory only and are not restrictive of the invention, as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

FIG. 8 is a perspective view of a second embodiment of a hanging sign of the present invention;

FIG. 9 is a top plan view of the second embodiment of the hanging sign shown in FIG. 8;

FIG. 10 is a cross-sectional view of the second embodiment of the hanging sign taken along line A—A in the direction indicated in FIG. 9;

DETAILED DESCRIPTION

Reference will now be made in detail to the presently preferred embodiments of the invention, examples of which are illustrated in the accompanying drawings. Wherever possible, the same reference numbers will be used throughout the drawings to refer to the same or like parts. These embodiments are intended to be purely exemplary of the invention.

The present invention provides a hanging sign that can display a message near an area to be emphasized, such as a hazardous area requiring pedestrian attention. The sign may be positioned in a variety of locations. For example, the sign may be located directly above a wet stair, on a hand rail assembly along a walk way, on a door handle to indicate a potential hazard beyond the door, on an out of service elevator, or in an area in need of a directional marker.

Figure 1:
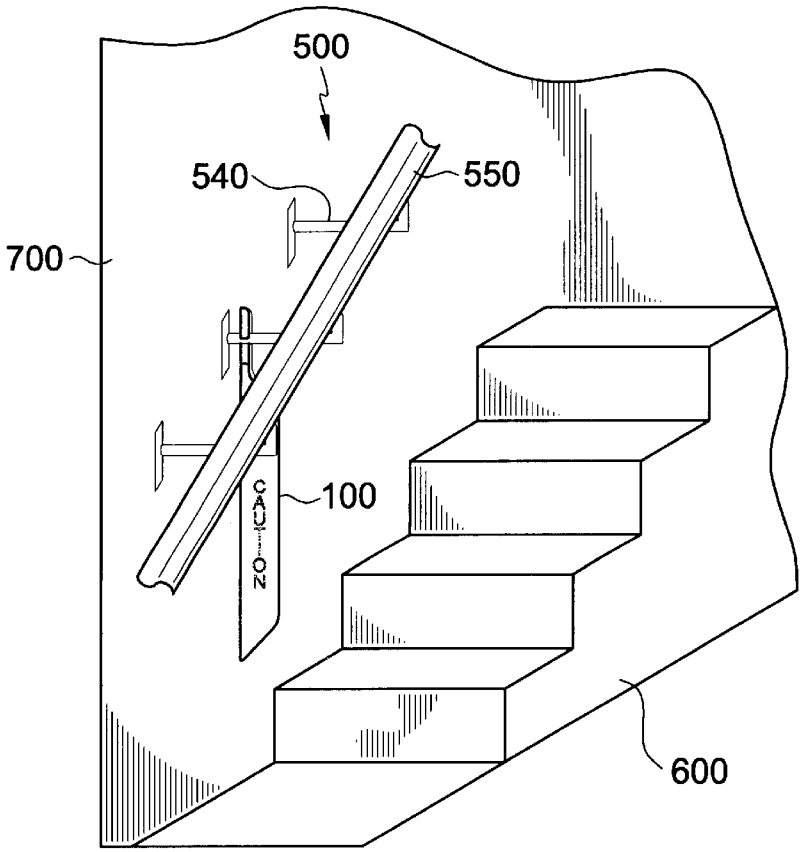
FIG. 1 is a pictorial representation view of a hanging sign of the present invention suspended from a handrail assembly.
Figure 2:
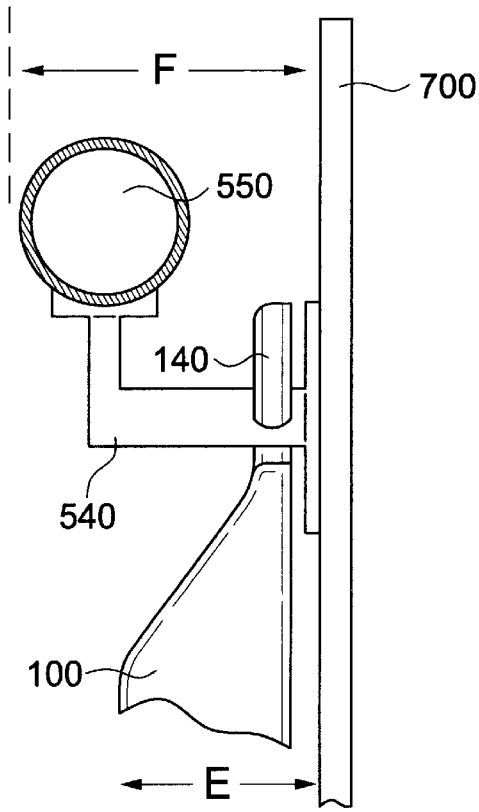
FIG. 2 is a side view of a hanging sign of the present invention suspended from a handrail.

FIGS. 1 and 2 generally show a hanging sign 100 according to the present invention. The sign 100 is suspended from a support above a walking surface so that the sign does not pose a trip hazard. The sign 10 may be hung, for example, from a handrail assembly 500 and, in particular, from a bracket 540 mounted on a wall 700 to hold a handrail 550. A handrail is often installed adjacent stairs 600. In some instances, however, handrails may be provided adjacent ramps or horizontal passageways.

Figure 6:
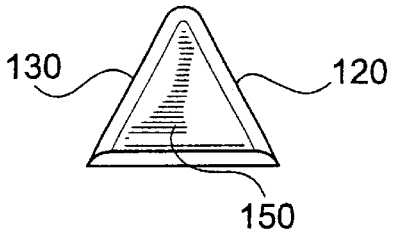
FIG. 6 is cross-sectional view of the first embodiment of the hanging sign taken along line B—B in the direction indicated in FIG. 4.

A first embodiment of a hanging sign 100 according to the present invention is disclosed in detail in FIGS. 3–7. The hanging sign 100 includes a pair of side walls 120, 130 (see FIG. 4) having first and second surfaces for displaying messages. In this embodiment, the side walls 120, 130 are connected to one another to form an inverted v-shaped cross-section, as shown in FIG. 6. The first and second surfaces face in generally opposing directions. For example, the side walls 120, 130 may be angled such that pedestrians walking up and down the stairs 600 (FIG. 1) are able to view at least one of the first and second message surfaces. Preferably, the first and second surfaces are positioned at an angle of between thirty-five and forty-five degrees with the vertical plane passing through the line A—A shown in FIG. 4. It is within the scope of the invention, however, to dispose the first and second surfaces in respective orientations that are appropriate for the circumstances encountered at the location where the sign is to be deployed.

Figure 4:
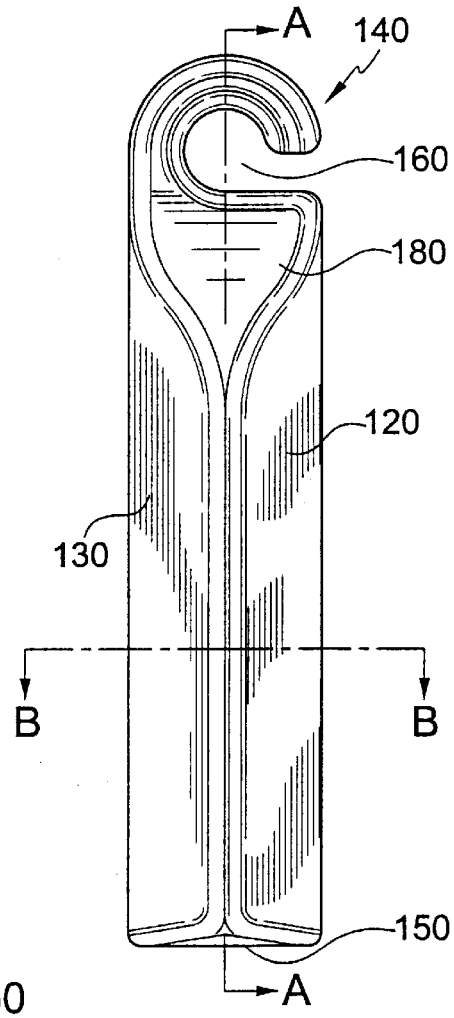
FIG. 4 is a top plan view of the first embodiment of the hanging sign shown in FIG. 3.
Figure 7:
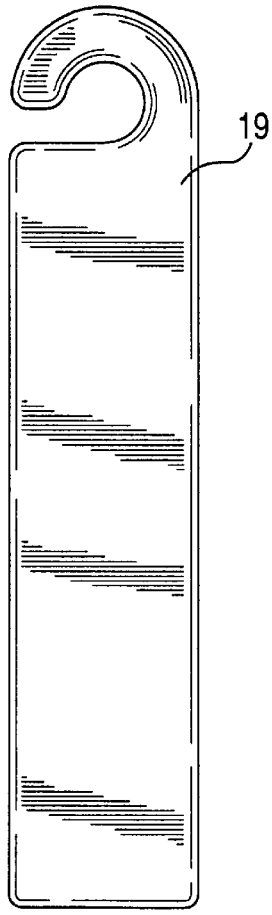
FIG. 7 is a bottom plan view of the first embodiment of the hanging sign of the present invention including a solid bottom wall.
Figure 3:
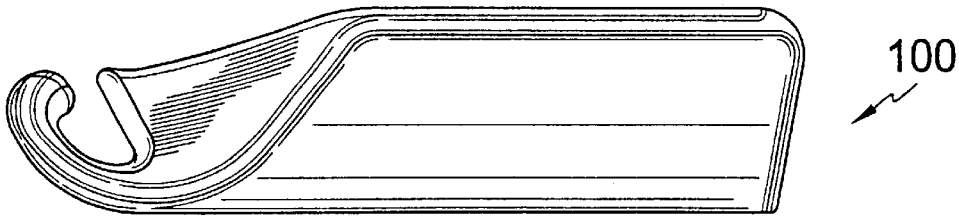
FIG. 3 is a perspective view of a first embodiment of a hanging sign of the present invention.
Figure 11:
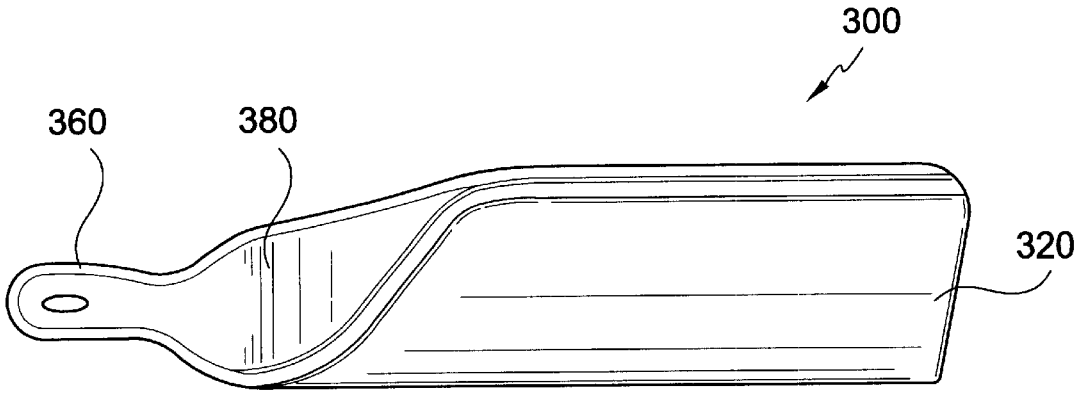
FIG. 11 is a perspective view of a third embodiment of a hanging sign of the present invention.

The sign 100 also includes a hook member 140 that may be placed about a structural support, such as bracket 540, to suspend the sign. The hook member 140 may include a generally circular opening 160, as shown in FIG. 4. The generally circular shape allows the hook member 140 to be placed around a variety of structural supports, such as a portion of a railing assembly or a door knob. As an alternative to hanging from the hook member 140, the sign 100 may include, for example, a magnet for retaining the wall against a metal surface or slots or openings for fastening the sign directly to a wall or support. The magnet may be used, for example, to position the sign on an elevator in order to communicate an "out of service" condition to a user.

The sign 100 may include a base wall 150 connected to the side walls 120, 130. The base wall 150 provides increased structural stability. Also, the base wall 150 provides a smooth contoured finish that minimizes the possibility of a pedestrian or object passing along the handrail assembly from being caught or snagged on the sign. The base wall 150 may be omitted, however, if desired to reduce the weight of the sign 100 or the amount of manufacturing material required.

A transition panel 180 can be provided to connect the hook member 140 to the side walls 120, 130. In FIG. 4, the transition panel 180 extends from the side walls 120, 130 and gently slopes toward the hook member 140. The transition panel 180 provides a transition from the three-dimensional message carrying portion of the sign to the hook member 140. The transition panel 180 also can provide another surface for displaying messages.

Figure 5:
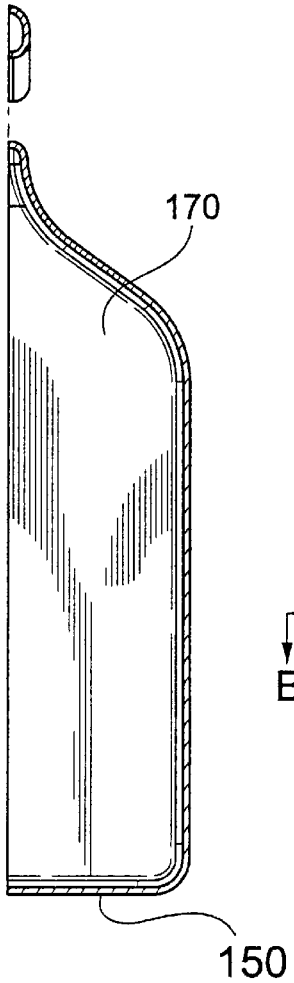
FIG. 5 is a cross-sectional view of the first embodiment of the hanging sign taken along line A—A in the direction indicated in FIG. 4.

The sign 100 preferably forms a cavity 170, as shown in the cross-sectional view of FIG. 5. The cavity 170 allows multiple signs to be nested or stacked together. This allows for efficient shipping and handling of a large number of signs. The depth of the cavity 170 and overall size of the sign may be varied as required.

The sign 100 having a cavity 170 is preferably injection molded from high density polypropylene. However, many other plastics well known to those of ordinary skill in the art may be suitable for making the sign from a molded or vacuum forming process. In addition, the sign 100 may be stamped or formed from a thin roll of metal such as steel or aluminum.

While certain advantages are associated with providing a sign having the cavity 170, it is within the scope of the invention to provide a back wall 190 (FIG. 7) to provide a lightweight, hollow structure. Furthermore, in some situations it may be desirable to form an essentially solid sign. In this case, the walls and interior of the sign all can be made of, for example, a lightweight, cushion type material such as foam rubber.

A second embodiment of the present invention is shown in FIGS. 8–10. The sign 200 of this second embodiment primarily differs from the first embodiment in the structure of the hook member 240, transition panel 280, and base wall 210. These features may be incorporated individually or collectively into the sign 100 of the first embodiment. Also, the various modifications of the first embodiment discussed above can be applied individually or collectively to the second embodiment.

In the sign 200 of the second embodiment, the hook member 240 includes a recessed portion 244 sized to fit commonly used handrail brackets, as shown in FIG. 9. For example, the diameter of the semi-circular recessed portion 244 is preferably approximately 1.2 inches. The hook member 240 may further include flat surfaces 242 located adjacent to the recessed portion 244. The flat surfaces 242 may be included to facilitate hanging the sign on a conventional janitorial cart such as, for example, the 6173 Janitor Cart manufactured by Rubbermaid Commercial Products LLC.

The transition panel 280 of the sign 200 includes a portion that extends between the side walls 220, 230, which can provide a surface for displaying cautionary messages, trade names, or the like. The transition panel 280 can minimize the protrusion of the sign away from, for example, a wall when positioned to hang from a handrail assembly. Compare FIG. 5 (first embodiment) with FIG. 10 (second embodiment). Preferably the depth of the sign 200, i.e. the distance D shown in FIG. 10, is approximately 2.5 inches so that when the sign 200 is suspended from a conventional handrail bracket it does not protrude into the passageway or stairway being transited. The depth and overall size of the sign may be varied to suit the particular purpose.

The base wall 210 of the sign 200 preferably is rounded. As shown in FIGS. 8 and 9, the base wall may take the shape of a half section of a truncated cone. In addition to the advantages of a base wall mentioned in connection with the first embodiment, the rounded appearance of the base wall 210 in the second embodiment increases the visibility of the sign.

The present invention offers several practical advantages. For example, as shown in FIG. 2, the narrow shape of the hook member 140 allows for a pedestrian's hand to grasp the rail 550 without interference from the sign 100. As a further example, the distance E that the sign 100 projects away from the wall 700 is less than the distance F that the handrail 550 extends into the passageway, thereby minimizing the likelihood of the sign 100 interfering with passing pedestrians. The preferred dimensions of the sign 100 are 17 inches in length by 6.25 inches wide by 2.5 inches deep to ensure that the above mentioned advantages are provided. The width of the hook member 140 is preferably ⅜ inch in order to avoid interference with the pedestrian's hand.

A third embodiment of the present invention is shown in FIGS. 11–14. The primary difference between the sign 300 of this third embodiment from the sign of the first embodiment is omission of the hook member 140 and the inclusion of a tab member 360. The tab member 360 may be incorporated into the sign 100 of the first embodiment. Also, the various modifications of the first and second embodiments discussed above may be applied individually or collectively to the third embodiment.

In the sign 300 of the third embodiment, the transition panel 380 is connected to a tab member 360. The tab member 360 may include an opening 365 sized to fit commonly used fasteners. The sign 300 may be secured to a support structure by passing a screw or other similar fastener through the opening 365 and securing the fastener to the support structure.

Figure 13:
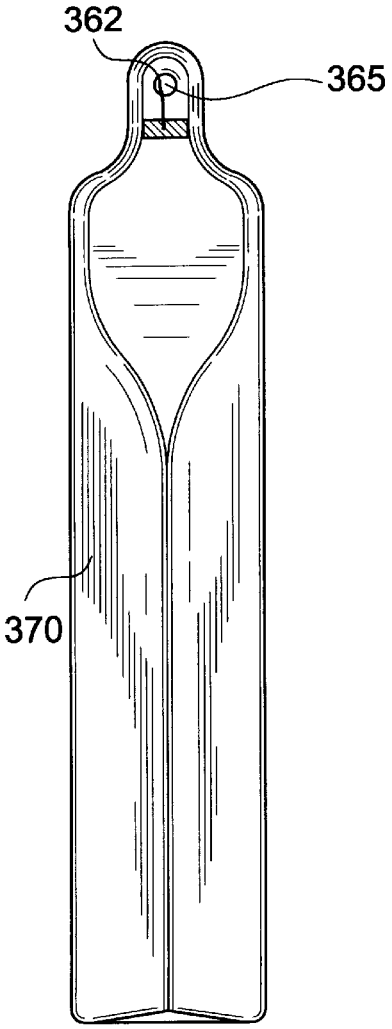
FIG. 13 is a bottom plan view of the third embodiment of the hanging sign of the presnent invention.
Figure 12:
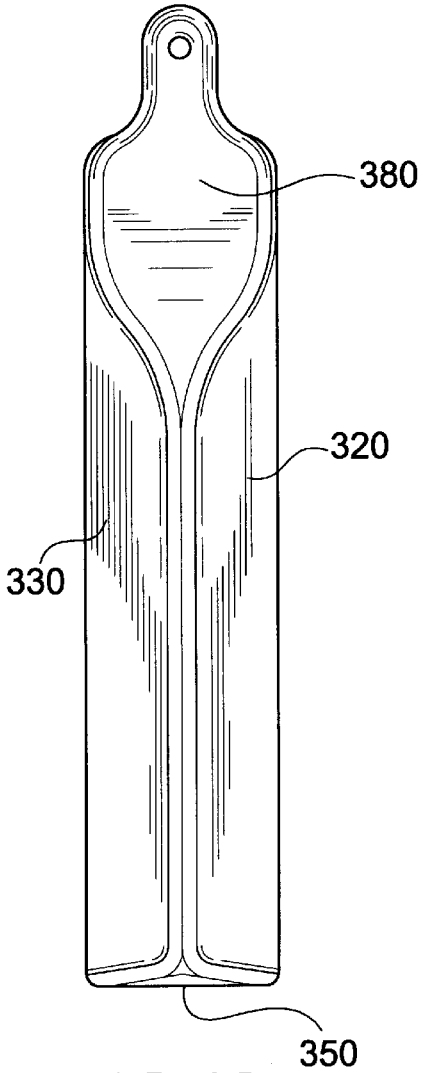
FIG. 12 is a top plan view of the third embodiment of the hanging sign shown in FIG. 11.
Figure 14:
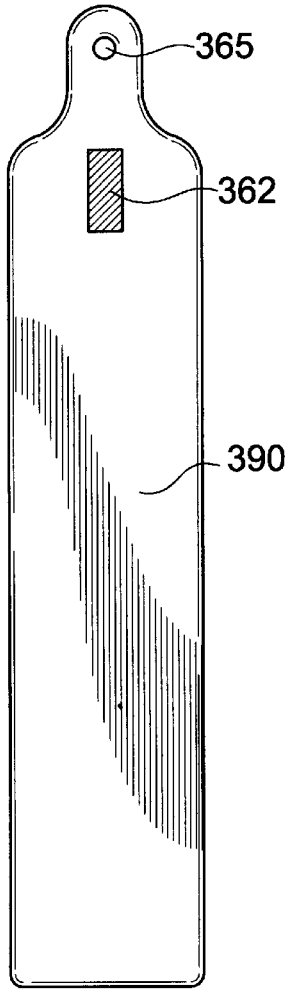
FIG. 14 is a bottom plan view of the third embodiment of the hanging sign of the present invention including a solid bottom wall.

As an acceptable alternative, the opening 365 may be omitted and a magnet 362 may be provided. As shown in FIG. 13, the magnet may be positioned on the bottom of the tab member 360 in order to avoid interference with cavity 370 formed by the side walls 320, 330 and the base wall 350. Alternatively, the magnet 362 may be positioned in any appropriate location that avoids interference with the cavity and the ability of multiple signs to be nested together. As shown in FIG. 14, the sign may include a solid back wall 390 and the magnet 362 may be mounted to the back wall. A fourth embodiment of the present invention is shown in FIGS. 15–18. As shown in FIG. 18, a hanging sign 400 may be suspended or hung from a handle 810 of a door 820.

The sign 400 has a display panel 410 that is angled away from the door 820 and toward the viewer to make it easier to receive the message. In addition, the three-dimensional shape of the sign 400 serves to alert pedestrians to the presence of the sign well before they arrive at the door.

The sign 400 includes a pair of side walls 420, 430. The side walls 420, 430 may be angled so that the width of each of the walls increases from the top to the bottom of the display panel 410. The shape of the side walls 420, 430 provides at least two advantages. First, the side walls tilt the display panel 410 away from the surface of the door 830 and toward the viewer thereby making the sign easier to read. Second, the side walls 420, 430 extend away from the door a sufficient distance so that the walls may be easily seen by pedestrians approaching the door from the side, thereby alerting the pedestrians to the presence of the sign and providing a heightened awareness of potentially dangerous conditions indicated on the display panel. It is within the scope of the invention to modify the angle and shape of the side walls in order to create the appropriate sign shape for the circumstances encountered at the location where the sign is to be deployed.

Figure 15:
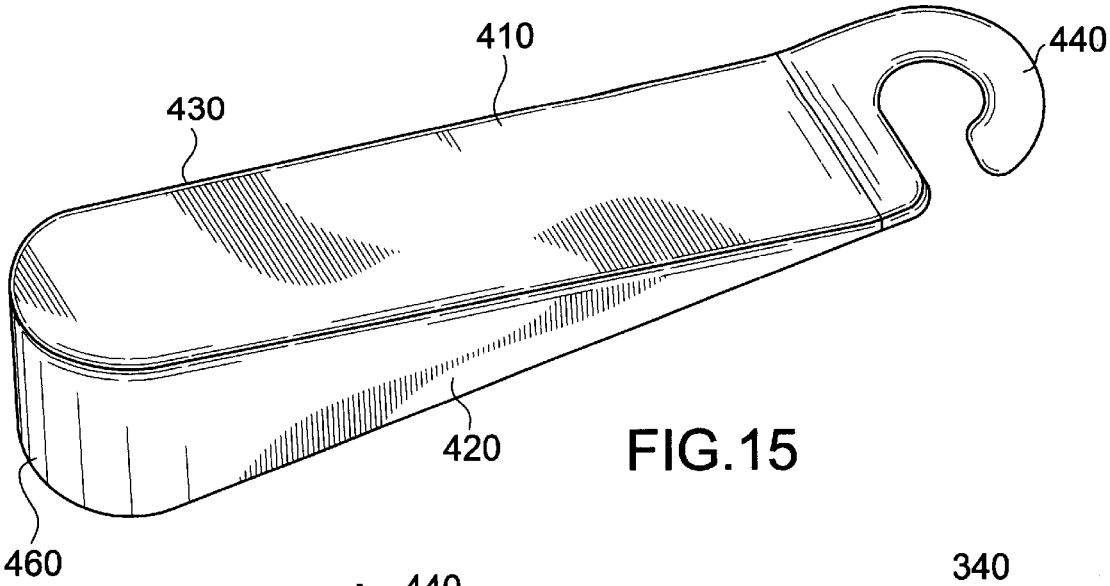
FIG. 15 is a perspective view of a fourth embodiment of a hanging sign of the present invention.
Figure 16:
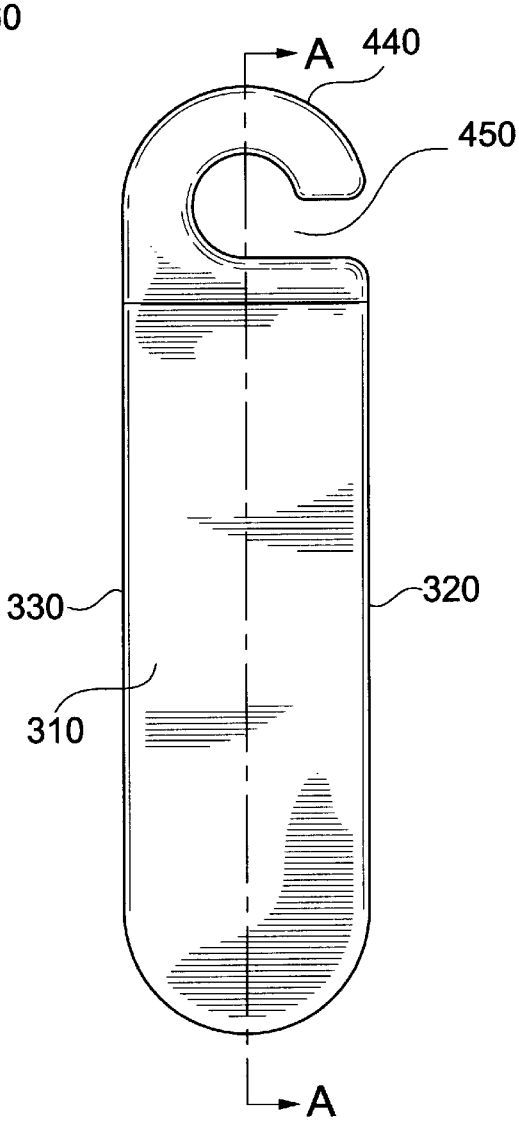
FIG. 16 is a top plan view of the fourth embodiment of the hanging sign shown in FIG. 15.

As shown in FIGS. 15 and 16, the display panel 410 is preferably a flat surface because it facilitates the display of messages. It is within the scope of the present invention, however, to provide a rounded or patterned surface for the display panel 310 as dictated by circumstances encountered in the area of use.

The sign 400 includes a hook member 440 that may be placed about a structural support to suspend the sign 400. The hook member 440 may surround a generally circular opening 450. The specific shape of the opening may be varied to suit the particular support being used. For example, the hook member 440 may be modified to include the recessed portion 244 and/or the flat portion 242 shown in FIG. 9. In addition to the door handle 810 shown in FIG. 18, the hook member 440 of the sign 400 may accommodate a wide range of bracket hardware. For example, the hook may be used on indoor or outdoor stair case railings. Alternatively, the sign 400 may include, for example, a magnet for retaining the wall against a metal surface or slots or openings for fastening the sign directly to a wall or support. As described above with regard to the other embodiments of the invention, the magnet may be used, for example, to position the sign on an elevator in order to communicate an "out of service" condition to a user.

The sign 400, may further include a base wall 460. The base wall 460 connects the side walls 420, 430 together and preferably is rounded, as shown in FIG. 15. The base wall 460 provides increased structural stability and the advantages associated with a smooth contoured finish.

Figure 17:
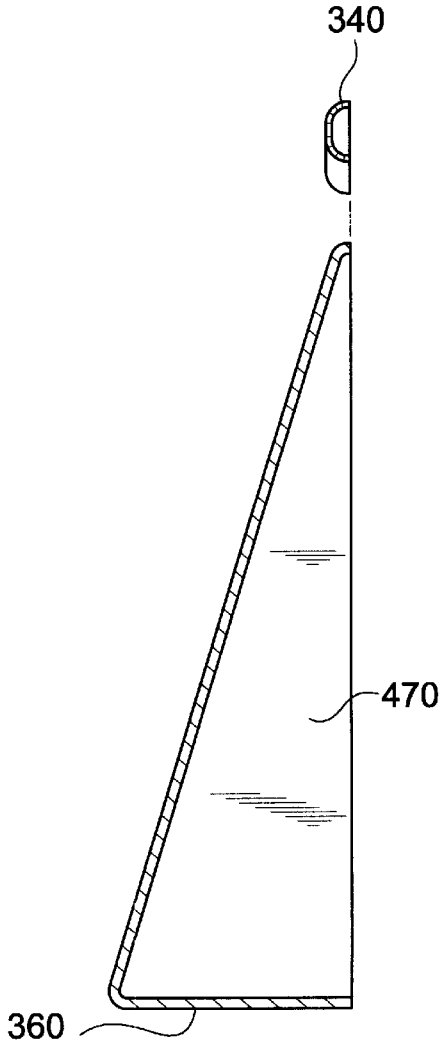
FIG. 17 is a cross-sectional view of the fourth embodiment of the hanging sign along line A—A in the direction indicated in FIG. 16.
Figure 18:
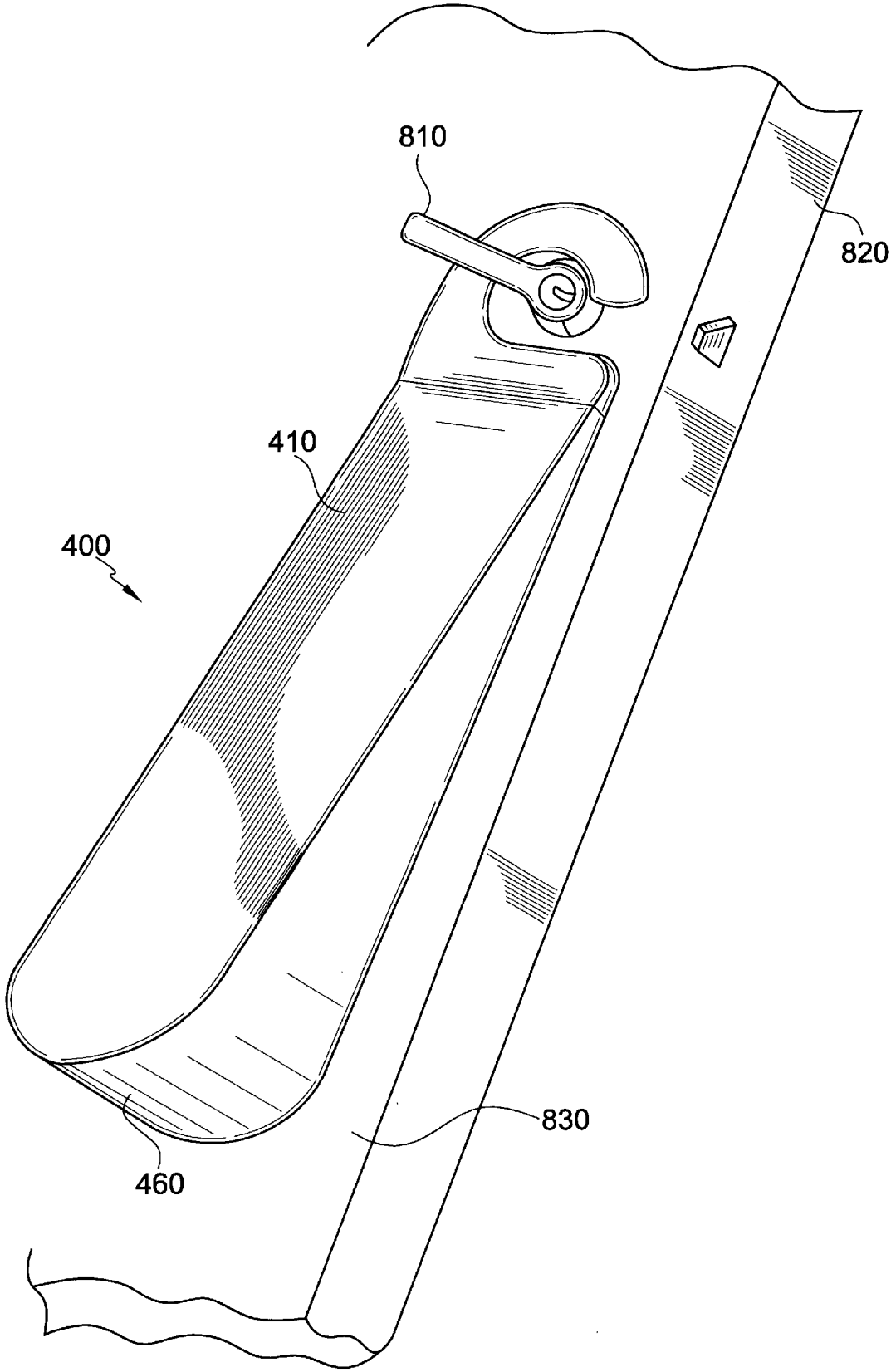
FIG. 18 is a pictorial representation of a hanging sign of the present invention hanging from a door handle.

The sign 400 preferably forms a cavity 470, as shown in the cross-sectional view of FIG. 17, to permit nesting or stacking and other advantages related shipping and handling of a large number of signs. While certain advantages are associated with having a cavity backed sign 400, it is within the scope of the invention to provide a solid back wall in order to provide a totally encased hollow enclosure. The solid back wall may take the form shown in FIG. 7, for example. Furthermore, as described above, in some situations it may be desirable to use a cushion type material such as foam rubber for the entire sign. In these cases, the sign 400 would have a solid interior.

Given the disclosure of the present invention, one versed in the art would appreciate that there may be other embodiments and modifications within the scope and spirit of the present invention. Accordingly, all modifications attainable by one versed in the art from the present disclosure within the scope and spirit of the present invention are to be included as further embodiments of the present invention. It is intended that the specification and examples be considered as exemplary only, with a true scope and spirit of the invention being indicated by the following claims.

What is claimed is:

1. A sign comprising:

a first wall having a first surface for displaying a message;

a second wall having a second surface for displaying a message, wherein said first and second surfaces face in generally opposing directions and each have a height in a height direction that is longer than a width in a width direction substantially perpendicular to the height direction; and a hook member disposed above the first and second surfaces along the height direction and configured to be placed about a support such that the sign hangs downward from the support in the height direction, wherein the first surface converges toward the second surface along the width direction.

2. The sign of claim 1, wherein said first and second walls are angled so that a distance between first side edges of said first and second walls is shorter than a distance between second side edges of said first and second walls.

3. The sign of claim 1, wherein a first side edge of said first wall is connected to a second side edge of said second wall.

4. The sign of claim 3, wherein said first and second walls are angled so that the cross-section of the sign is v-shaped.

5. The sign of claim 1, further comprising a base wall extending between said first wall and said second wall and having one side edge connected to a bottom edge of said first wall and another side edge connected to a bottom edge of said second wall, said first and second walls and said base wall forming a cavity to permit nesting of another sign within said cavity.

6. The sign of claim 5, further comprising a transition panel positioned between said first, second, and base walls and having a first side edge connected to a side edge of said first wall and a second side edge connected to a side edge of said second side wall and a bottom edge connected to the top edge of said base wall.

7. The sign of claim 5, wherein the depth of said cavity is less than three inches.

8. The sign of claim 5, wherein said base wall is in the shape of a half section of a truncated cone cut vertically through the longitudinal axis of the cone.

9. The sign of claim 1, wherein said hook member includes a recessed region for receiving a cylindrical shaft.

10. The sign of claim 1, wherein the first and second walls are exterior side walls of a solid enclosure.

11. The sign of claim 1, wherein the first and second walls form side walls of a hollow enclosure.

12. The sign of claim 1, further comprising a third wall, said first, second and third walls forming side walls of a hollow enclosure.

13. A staircase sign for hanging on a hand railing assembly for a staircase, comprising:

a first wall for displaying information in the direction of the top of the staircase;

a second wall for displaying information in the direction of the bottom of the staircase, wherein said first and second walls face in generally opposing directions and each have a height in a height direction and a width in a width direction substantially perpendicular to the height direction and wherein the first wall converges toward the second wall along the width direction; and a hook member disposed above the first and second walls along the height direction and configured to be placed about a portion of the hand railing assembly such that the sign hangs downward from the portion of the hand railing assembly in the height direction.

14. The staircase sign of claim 13, further comprising a base wall connected to bottom edges of said first and second walls.

15. The staircase sign of claim 13, wherein said first and second walls and said base wall form a cavity to permit nesting of another staircase sign within said cavity.

16. The staircase sign of claim 13, wherein said first and second walls are connected so that the sign has a v-shaped cross-section.

17. The staircase sign of claim 13, wherein said hook member includes a recess for receiving the portion of the railing assembly.

18. The staircase sign of claim 13, further comprising a transition member extending between said hook member and said first and second walls.

19. The staircase sign of claim 13, wherein said portion of the railing assembly is a bracket.

20. The staircase sign of claim 13, wherein said first and second walls are exterior side walls of a solid enclosure.

21. The staircase sign of claim 13, wherein said first and second walls are exterior walls of a hollow enclosure.

22. A sign comprising:

a first wall having a first surface for displaying a message, the first wall having a rearward edge substantially in a first plane;

a second wall having a second surface for displaying a message, wherein said first and second surfaces face in generally opposing directions, the second wall having a rearward edge substantially in the first plane, wherein said first and second walls each have a height in a height direction that extends along the first plane and a width in a width direction substantially perpendicular to the height direction; and a hook member connected to said walls and configured to be placed about a support, the hook member disposed above the first and second walls along the height direction and extending substantially in the first plane.

* * * * *